United States Patent [19]

Sarazen, Jr. et al.

[11] Patent Number: 4,962,882

[45] Date of Patent: Oct. 16, 1990

[54] VENTILATOR

[76] Inventors: Paul M. Sarazen, Jr., 214 Fairview Dr.; Dennis A. Beam, Jr., 410 Westfield Dr., both of Shelby, N.C. 28150

[21] Appl. No.: 443,215

[22] Filed: Nov. 27, 1989

[51] Int. Cl.[5] ..... F24F 13/15

[52] U.S. Cl. ..... 236/49.5; 98/40.25; 137/601

[58] Field of Search ..... 236/49.5; 98/40.25, 98/40.24, 107, 110, 121.2; 137/601

[56] References Cited

U.S. PATENT DOCUMENTS

| | | | |
|---|---|---|---|
| 302,215 | 7/1884 | Tucker | 236/49 |
| 1,335,929 | 4/1920 | Allen | 236/49 |
| 1,358,193 | 11/1920 | Fulton | 236/49 |
| 2,117,529 | 5/1938 | Wile et al. | 236/49.5 |
| 2,187,767 | 1/1940 | Akers | 236/49 |
| 2,216,873 | 10/1940 | Browne | 236/49 |
| 2,241,108 | 5/1941 | Akers | 236/49.5 |
| 2,551,965 | 5/1951 | Petersen et al. | 236/49 |
| 2,814,977 | 12/1957 | Noll | 236/49 |
| 2,975,975 | 3/1961 | Weber | 236/49.5 |
| 3,027,090 | 3/1962 | Zerhan, Jr. | 236/49.5 |
| 3,068,776 | 12/1962 | Day | 236/49.5 |
| 3,195,441 | 7/1965 | Hedrick | 236/49.5 |
| 3,368,756 | 2/1968 | Edwards | 236/49 |
| 3,436,016 | 4/1969 | Edwards | 236/49 |
| 3,528,606 | 9/1970 | Witten | 236/49 |
| 4,151,952 | 5/1979 | Edwards | 236/49 |
| 4,175,480 | 11/1979 | Beam, Jr. et al. | 98/37 |
| 4,208,010 | 6/1980 | Beam, Jr. et al. | 236/49 |
| 4,210,279 | 7/1980 | McSwain | 236/49 |
| 4,231,514 | 11/1980 | McSwain | 236/49 |
| 4,243,175 | 1/1981 | McSwain | 236/49 |
| 4,274,330 | 6/1981 | Witten et al. | 98/37 |
| 4,290,554 | 9/1981 | Hensley | 236/49 |
| 4,328,927 | 5/1982 | McSwain | 236/49 |
| 4,417,687 | 11/1983 | Grant | 98/121.2 X |
| 4,493,456 | 1/1985 | Sarazen, Jr. et al. | 236/49 |
| 4,715,532 | 12/1987 | Sarazen, Jr. et al. | 236/49 |
| 4,754,696 | 7/1988 | Sarazen et al. | 98/29 |

*Primary Examiner*—William E. Tapolcai
*Attorney, Agent, or Firm*—Dority & Manning

[57] ABSTRACT

A ventilator opens and closes itself according to the temperature in its environment through the use of a bimetallic coil spring which acts through a drive element and linkage elements to open and close the louvers of the ventilator. The louvers are disposed in an air passageway that is defined by a housing, which defines a spring box to house the coil. The louvers are configured with an S-shaped cross section so as to provide positive engagement between the louvers when they are in the closed position. The drive element and a linkage element have rotation post with bifurcated flared heads that rotatably engage the louvers for simultaneous movement. A removable backframe has projecting tabs that fit into holes defined near the rear edge of the housing. The backframe has a closure surface for engaging a forward-extending free edge of the uppermost louver. The backframe also has a closure stop member that engages the lowermost edge of the bottom louver. The backframe has a louver rotation stop member that prevents the louvers from rotating beyond a certain point when opened. A front panel and a closure flap prevent the passage of air and light in the vicinity of the spring box. The backframe preferably is formed as a unitary structure of molded plastic. The housing, the spring box, and a collar surrounding the exterior of the housing preferably are formed as a unitary structure of molded plastic.

20 Claims, 3 Drawing Sheets

VENTILATOR

BACKGROUND OF THE INVENTION

The present invention relates to a ventilator structure of the type that is normally disposed in the foundation of a dwelling or other building structure. More particularly, the present invention relates to a ventilator with automatic, temperature responsive means for opening and closing the ventilator to the passage of air therethrough.

A number of automatic, temperature responsive ventilators are known, including French Pat. No. 1,377,998 and those disclosed in the following U.S. Pat. Nos.:

| U.S. Pat. No. | Inventive Entity |
|---|---|
| 4,754,696 | Sarazen et al |
| 4,715,532 | Sarazen, Jr. et al |
| 4,493,456 | Sarazen, Jr. et al |
| 4,328,927 | McSwain |
| 4,290,554 | Hensley |
| 4,274,330 | Witten et al |
| 4,243,175 | McSwain |
| 4,231,514 | McSwain |
| 4,210,279 | McSwain |
| 4,208,010 | Beam, Jr. et al |
| 4,175,480 | Beam, Jr. et al |
| 4,151,952 | Edwards |
| 3,528,606 | Witten |
| 3,436,016 | Edwards |
| 3,368,756 | Edwards |
| 3,195,441 | Hedrick |
| 3,068,776 | Day |
| 3,027,090 | Zerhan, Jr. |
| 2,975,975 | Weber |
| 2,814,977 | Noll |
| 2,551,965 | Petersen et al |
| 2,241,108 | Akers |
| 2,216,873 | Browne |
| 2,187,767 | Akers |
| 2,117,529 | Wile et al |
| 1,358,193 | Fulton |
| 1,335,929 | Allen |
| 302,215 | Tucker |

A bimetallic element provides a temperature operative mechanism to open and close the shutter elements of many of these vents. For example, a relatively wide coil is used in the Edwards '016 vent and in the Noll device. Sarazen et al '696 uses a narrower coil than the Edwards '016 vent. A spiral spring provides the temperature responsive element in the Edwards '756 vent. An elongated helical spring is used in an embodiment of the McSwain '514 device, in the Edwards '952 device, and in the McSwain '175 device.

The bimetallic element has been disposed at a number of different locations relative to the housing which defines the air passageway. In devices such as shown in Witten '606, a coil spring is located in an enclosed box on the exterior of one sidewall which defines the air flow passageway. This arrangement requires the size of the installation opening to be increased merely to accommodate the box. In the Edwards '016 device, the Beam, Jr. et al '480 device, and the Sarazen. Jr. et al '456 device, the coil spring is located in the air flow passageway of the ventilator in a central opening in one of the louvers. In the Sarazen, Jr.et al '696 device, the spring is located in the air flow passageway in an opening at one end of a louver. These arrangements require clearance space around the spring to enable the spring to expand, and this space admits air drafts and light through the louver and is aesthetically undesirable. Ventilators with relatively thick sidewalls such as McSwain '279, house the thermally responsive spring in an opening shown at 28 in FIG. 2 provided in the sidewall of the ventilator housing. This arrangement requires a compromise between the thickness of the sidewall and the depth of the spring. A sidewall that is too thick wastes material and/or destroys the symmetry of the vent. A spring that is too thin limits either the size and number of louvers which can be driven or limits the range of the louvers' movement.

A number of different ways of operatively connecting the bimetallic elements to propel movement of the louvers have been used. The outer end of the thermally responsive coil spring is secured to one of the louvers in ventilators such as Sarazen, Jr. et al '456 (middle of louver) and Sarazen et al '696 (end of louver). In the Sarazen, Jr. et al '456 device, the inner end of the coil spring is fixed to a stationary support rod. In the Sarazen, Jr. et al '696 device, a setting plug 35 extends through an opening in the sidewall to hold the inner end of the coil spring against rotation. Edwards '016 has a single, centrally disposed rod 36 secured to L-shaped lugs 34, which in turn are attached to louvers 26 for simultaneous movement with rod 36, and one louver is attached to the outer end of spring 40. In the Beam, Jr. et al '480 device, the inner end of the coil spring is attached to a stationary support rod for the louver, and the outer end attached directly to the surface of the louver. The McSwain '927 device connects the outer end of the coil spring to the louver and the inner end of the coil spring has a projection that extends outwardly and is received and nonrotatably held in an opening provided in the sidewall of the housing that defines the air flow passageway. The projection of the inner end of the spring provides an axis of rotation for the louver as the projection extends through an opening in a flange that extends from the louver blade. In the McSwain '279 device, the inner end of the coil spring is secured to the axis of rotation of one of the shutter elements, and the outer end of the coil spring is held in a slot formed in the boundary of an opening provided in the sidewall of the housing that defines the air flow passageway. Thus, in this McSwain '927 device and the McSwain '279 device, the inner end of the spring must carry the weight of the louver blade.

Moreover, devices which attach the spring to the louver element itself generally require about a 60° range of movement of the spring between the open and closed positions of the louvers. A smaller range of spring movement to effect the same range of louver movement is desirable. This has been accomplished by attaching the spring to a linkage element which uses leverage to drive the louvers with a shorter range of spring movement. For example, Hensley '554 holds the inner end of the coil spring, which is mounted in a box on the exterior of the housing, in a bifurcated stud 43 extending outwardly through the sidewall of the housing. The outer end of the coil spring extends loosely through a slot 45 in an extension 35' of an actuator bar 35, which connects the three louvers for simultaneous movement. The Witten '606 device holds the inner end of spring 60 stationary by mounting it in a bolt 61, and attaches the outer end of spring 60 to a linkage in the form of connecting member 53 disposed outside of the housing which defines the air passageway. Hensley '554 disposes the bar inside the air passageway, while Witten '606 disposes the connecting member in the box on the outside of the air passageway housing.

Substantially complete blockage of air and light when the louvers are in the closed position is desireable. This is accomplished in arrangements such as shown in U.S. Pat. No. 3,202,082 to Viehmann (not a temperature actuating ventilator), in which each louver has oppositely disposed free edges configured to contact the overlapping free edge of the adjacent louver. Moreover, the lowermost louver has a lower free edge that overlaps and contacts an upwardly projecting member of the frame which surrounds the louvers. However, to allow free louver movement between the closed and open position, the upper free edge of the uppermost louver is free in the closed position, and thus a clearance space exists between it and the frame. This space may produce an undesirable whistle in the wind.

Adequate clearance between the housing and the uppermost and lowermost louvers must be provided. However, in vents in which the housing, louvers, and connecting elements are fabricated from molded plastic, clearance tolerances for the space between the top and bottom louvers must be large enough to accommodate warpage of the molded plastic elements. Thus, in the Hensley '554 vent for example, which is fabricated of molded plastic, when the louvers are in the closed position the upper free edge of the uppermost louver and the lower free edge of the lowermost louver do not directly contact the top and bottom surfaces defining the air passageway and have a generous clearance space between themselves and the passageway walls.

Because these ventilators are typically installed in the walls of foundations, the air flowing against them and through them deposits dirt and dust on them and in them. Unless this dust and dirt is removed, the airflow eventually carries both into the dwelling. Most ventilators cannot be cleaned without being removed from the foundation and/or disassembled at least in part. With most ventilators, removal and/or even partial disassembly is either difficult and/or impossible without damaging the ventilator or the skillful use of tools. With those that can be disassembled, one cannot always gain unimpeded access to the louvers for cleaning, much less remove them for cleaning.

OBJECTS AND SUMMARY OF THE INVENTION

It is a principal object of the present invention to provide a ventilator that is simple and inexpensive to manufacture yet has reliable automatic, temperature-responsive opening and closing louvers that provide positive, air-tight and light-blocking closure.

It is another principal object of the present invention to provide a temperature actuating ventilator that is simple and easy to disassemble for the purpose of cleaning same without damaging the ventilator or the installation opening in the process of disassembly.

A further principal object of the present invention is to provide a temperature actuating ventilator that can be fabricated substantially entirely of molded plastic parts that can be assembled and disassembled manually without the aid of tools.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the temperature actuating ventilator of the present invention comprises a housing, a removable backframe, means for removably engaging the backframe to the housing, a plurality of louvers, means for positively engaging the louvers when they are in a closed position, means for supporting each louver for rotation about a longitudinal axis of rotation, means for linking the louvers for simultaneous rotation about the longitudinal axis of rotation of each louver, a bimetallic coil, and a spring box. As embodied herein, the housing preferably defines an enclosed air passageway therethrough and includes a top, a first sidewall, a bottom, and a second sidewall, all integrally connected to one another. The top, bottom, and two opposite sidewalls preferably form a unitary structure that is molded from a polymeric material such as polyvinyl. The housing, and its component parts, define a front edge and a rear edge disposed opposite the front edge.

The removable backframe is configured to engage the rear edge of the housings so as to be selectively disengagable by ordinary manual dexterity and without the aid of tools. The backframe preferably includes a top ledge connected to a bottom ledge by two opposing side struts. Preferably, the backframe is formed as a unitary structure that has been molded out of a polymeric material such as polycarbonate. Abutment ridges extend from respective intermediate portions of the exterior surfaces of each of the top and bottom ledges. When the backframe engages the rear edge of the housing, the abutment ridges are disposed immediately adjacent the rear edge of the housing. A plurality of ribs preferably extends between the top and bottom ledges, and at least one cross brace extends between the two side struts to provide rigidity to the backframe.

In accordance with the present invention, means are provided for removably engaging the backframe to the housing. The engaging means permits selective engagement and disengagement by the application of manual force and no more than ordinary dexterity without the aid of tools. As embodied herein, the engaging means preferably includes a pair of top tab openings defined in the housing top, a pair of bottom tab opening defined in the housing bottom, a pair of attachment tabs projecting outwardly from the exterior surface of the backframe's top ledge, and another pair of attachment tabs similarly projecting from the backframe's bottom ledge. The respective tab openings are disposed closer to the rear edge of the housing than to the front edge. The attachment tabs are disposed so as to be in registry with the tab openings in the housing. The relative flexibility of the preferred polyvinyl plastic which forms the housing combines with the relatively rigid and stiff polycarbonate material preferred for the backframe to facilitate a snap-in engagement and snap-out disengagement of the backframe to the housing.

Preferably, a bimetallic element in the form of a concentrically wound coil spring provides the motive force 10 that opens and closes the louvers in response to temperature changes in the environment of the ventilator.

In further accordance with the present invention, a box is provided for housing the bimetallic spring. As embodied herein, a spring box preferably is disposed on an interior surface of one of the sidewalls of the housing. The box has a sidepanel disposed opposite the adjacent sidewall of the housing and a solid front panel that is disposed closer to the front edge of the housing than to the rear edge and shields the spring contained in the box from exposure to the environment. Preferably, the spring box has five sides and an open back, the latter to permit he temperature of the environment to affect how tightly the spring is wound. A setting plug hole preferably is defined through the first sidewall in the vicinity of the spring box. A setting plug has a bifurcated end that extends through the setting plug hole and holds an inner free end of the coil spring against rotation. The setting plug preferably is adjustable relative to the setting plug hole to enable the tension and orientation of the coil spring to be adjusted as the setting plug is turned.

In still further accordance with the present invention, louvers are rotatably disposed across the air passageway. At one rotational position of the louvers, the air passageway is open and admits air and light through the ventilator. In another position of the louvers, the air passageway is closed to prevent air and light from passing through the ventilator. Intermediate positions permit varying degrees of air and light to pass through the ventilator. The particular position of the louvers is determined by the temperature conditions, because-the temperature causes the bimetallic coil to expand and contract, which is translated into louver movement, as explained more fully below. As embodied herein, three louvers are provided. Generally, the fewer the number of louvers, the wider the louvers must be in order to completely cover the available cross section of the air passageway. A larger number of louvers permits the individual louvers to be narrower and accordingly the depth of the ventilator can be narrowed.

Each louver defines an elongated body with a longitudinal axis along the length of same. A top louver preferably is disposed adjacent the spring box and is shorter in length than the other two louvers. A middle louver preferably is disposed between the other two louvers and has a transverse cross-section that defines a generally S-shaped configuration and includes a rearward-extending free edge and a forward-extending free edge as part of the S-shape. The top louver has a similar S-shaped cross-sectional configuration. However, the bottom louver preferably has a flat trailing edge in place of the rearward-extending free edge found in the other two louvers. Preferably, in the closed position, the forward-extending edge of the middle louver engages the rearward-extending edge of the top louver, while the rearward-extending free edge of the middle louver engages the forward-extending edge of the bottom louver to provide positive closure surfaces for the louvers. This positive closure feature of the louvers facilitates blockage of both light and air when the louvers are in the completely closed position.

In further accordance with the present invention, means are provided for positively engaging the louvers when the louvers are in a closed position. In addition to the particular positive closure surfaces of the louvers discussed above, the means for positively engaging the louvers when they are in a closed position further preferably includes a closure surface extending at a right angle from the top ledge of the backframe. This closure surface extends toward the bottom ledge and also extends lengthwise for substantially the entire length of the top ledge. In the closed position, the forward-extending edge of the top louver positively engages the closure surface to block the passage of air and light. Moreover, the means for positively engaging the louvers also preferably includes at least one closure stop member that extends above the interior surface of the bottom ledge. The closure stop member preferably extends to the forward free edge of the bottom ledge, and a plurality of closure stop members preferably are provided. Each closure stop member provides a stop surface that engages the lowermost edge of the bottom louver. Thus, the thickness of the forward free edge of the bottom ledge is augmented by the closure stop members. This renders the amount of clearance needed between the lowermost edge of the bottom louver and the housing bottom less critical. Reducing the criticality of this clearance tolerance assures reliable functioning of the present invention's preferred plastic molded parts, which otherwise might prove too difficult to hold to more stringent clearance tolerance specifications.

In yet further accordance with the present invention, means are provided for rendering the closed ventilator substantially air tight and light-tight. As embodied herein, in addition to the positive closure surfaces of the louvers, the closure surface of the backframe's top ledge, and the closure stop members of the bottom ledge, all discussed above, such means preferably includes a closure flap that extends at a right angle from the top ledge. The closure flap preferably extends toward the bottom ledge for a greater distance than the closure surface. Preferably, the closure flap is disposed so as to be in at least partial registry with the spring box and to block the spacing that may exist between the box's sidepanel and the end of the top louver that is disposed adjacent the sidepanel. This preferred orientation of the closure flap prevents the passage of air and light between any spacing that exists between the sidepanel and the end of the top louver.

Preferably, the backframe, the closure surface, the closure stop member, and the closure flap define a unitary structure that is formed by molding a polymeric material in a single mold.

In still further accordance with the present invention, means are provided for supporting each of the louvers for rotation about its longitudinal axis of rotation. As embodied herein, such means preferably includes louver post holes defined through the sidewalls, pivot bolt recesses defined longitudinally in the ends of the louvers, and pivot bolts disposed through the louver post holes in the sidewalls and into the pivot bolt recesses defined in the louvers to rotatably support the louvers thereon. The end of the top louver that is disposed adjacent the spring box is rotatably supported by a pivot bolt that extends through a pivot bolt hole defined by a pivot bolt collar, which is defined near the free edge of the sidepanel of the spring box. A pivot bolt extends through this pivot bolt hole defined in the pivot bolt collar and rotatably supports the end of the top louver adjacent the sidepanel. In order to provide the pivot bolt hole in the sidepanel, provision must be made for the insertion of a tool into the mold which preferably forms the spring box as a unitary structure of the housing. This preferably is accomplished by providing a tool access opening defined through the first sidewall and oriented in registry with the pivot bolt hole to be defined in the sidepanel of the spring box. An insert can be provided to fill this tool access opening and thus seal same in the finished ventilator.

In still further accordance with the present invention, means are provided for linking the louvers for simultaneous rotation about their longitudinal axes of rotation. As embodied herein, the louver linking means preferably includes a drive element, a linkage element, and a plurality of receiving collars which define respective rotation post holes. The drive element preferably defines an elongated member that has at least two rotation posts extending at right angles therefrom and spaced apart to correspond to the spacing between the bottom louver and the middle louver. One end of the drive element has a forked member that holds the outer end of the coil therein. Each of the rotation posts defines a bifurcated shaft that has a flared head at the free end thereof. Each end of the bottom louver and the middle louver have a receiving collar defined thereon with a rotation post hole therethrough. Each receiving collar, and its rotation post hole, is oriented at a location that does not coincide with the rotational axis of the louver. In this way, any pressure applied at the site of the rotation post hole acts to rotate the louver about the axis of rotation. The rotation posts of the drive element can be manually squeezed together sufficiently to be inserted through the receiving collars in the ends of the bottom and middle louvers disposed near the spring box. The linkage element defines an elongated member having at least three rotation posts defined thereon and spaced apart according to the relative spacing of the three louvers. Each rotation post of the linkage element is disposed through a corresponding rotation post hole defined through the respective receiving collar mounted on the end of the louver that is disposed opposite the spring box.

The bifurcated flared head of the rotation post permits the louvers to be engaged and disengaged from the linkage and drive elements with the application of ordinary manual dexterity unaided by tools.

The housing further preferably defines a front edge collar around the periphery thereof and a grille extending across the air passageway. The unitary construction of the housing and spring box also preferably extends to include the collar and the grille. A nylon or metallic fine mesh screen can be provided across the grille and can be adhered to same by melt welding the screen to the plastic grille.

In yet further accordance with the present invention, means can be provided for securing the ventilator in the installation opening. As embodied herein, the installation opening securing means preferably includes resilient, deformable installation clips, which can be held at one end by clip holders disposed on the exterior surface of the top of the housing and/or the bottom of the housing. In addition, the installation opening securing means can include an attachment opening defined through one of the sidewalls and configured to nonrotatably receive a nut. Preferably, the nut has a threaded opening therethrough that receives a threaded installation bolt which can be screwed through the nut and into the surrounding installation opening to secure the ventilator.

The accompanying drawings, which are incorporated in and constitute a part of this specification, illustrate one embodiment of the invention and, together with the description, serve to explain the principles of the invention.

DETAILED DESCRIPTION OF THE PREFERRED EMBODIMENTS

Reference now will be made in detail to the present preferred embodiments of the present invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover the modifications and variations of this invention provided they come within the scope of the appended claims and their equivalents.

The present invention pertains especially to vents in which substantially all of the parts other than the bimetallic spring, are fabricated with plastic parts that have been formed in molds. The molding process itself imposes certain limitations on the working tolerances that can be attained in the finished product. However, the present invention comprises a structure that overcomes these limitations to yield a product that functions reliably in both the open and closed positions and is easily installed. Once installed, the ventilator of the present invention is easily disassembled by hand and without the aid of tools. The disassembled parts can be cleaned and easily reassembled by hand, again without the aid of tools.

Figure 1:
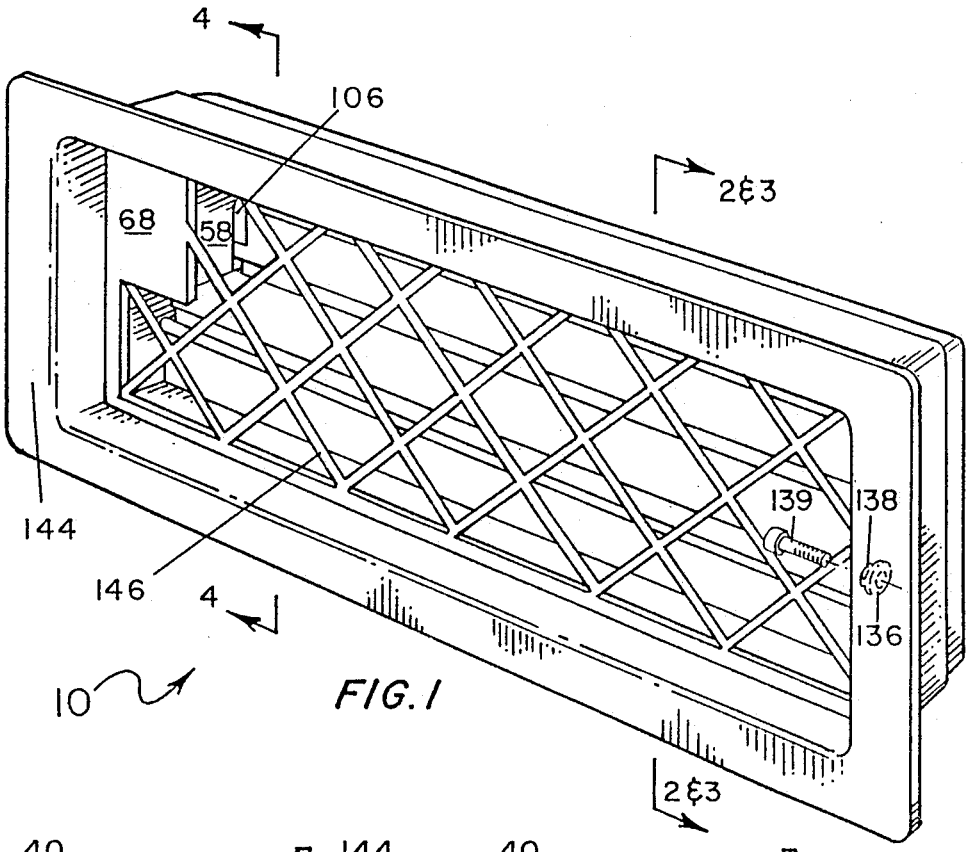
FIG. 1 illustrates a front perspective plan view of an embodiment of the ventilator of the present invention.

A preferred embodiment of the temperature-responsive, self-actuating ventilator of the present invention is shown in FIG. 1 and is represented generally by the numeral 10. The ventilator of the present invention comprises two main parts, namely, a housing, which is indicated generally in FIG. 7 by the numeral 12, and a backframe, which is indicated generally in FIG. 7 by the numeral 14. Both housing 12 and backframe 14 are preferably manufactured of molded polymeric material. For example, housing 12 preferably is fabricated from a polyvinyl material, while backframe 14 is preferably fabricated from a polycarbonate material. Accordingly, housing 12 is more flexible, while backframe 14 is more rigid.

In accordance with the present invention, a housing is provided to define an air passageway 13 therethrough. The housing preferably integrally defines a top, a first sidewall, a bottom, and a second sidewall. As embodied herein and shown in FIG. 7 for example, housing 12 defines a unitary structure that includes a top 16, a first sidewall 18, a second sidewall 20 disposed opposite first sidewall 18, and a bottom 22 disposed opposite top 16. First sidewall 18 connects a first end of top 16 and a first end of bottom 22, while second sidewall 20 connects a second end of top 16 to a second end of bottom 22. Each of sidewalls 18, 20 has an interior surface 24 facing toward one another, and an exterior surface 26 facing away from one another. Moreover, housing 12, and accordingly each of top 16, bottom 22, and sidewalls 18, 20, all of which define housing 12, define a front edge 28 and a rear edge 30 disposed opposite front edge 28.

Figure 2:
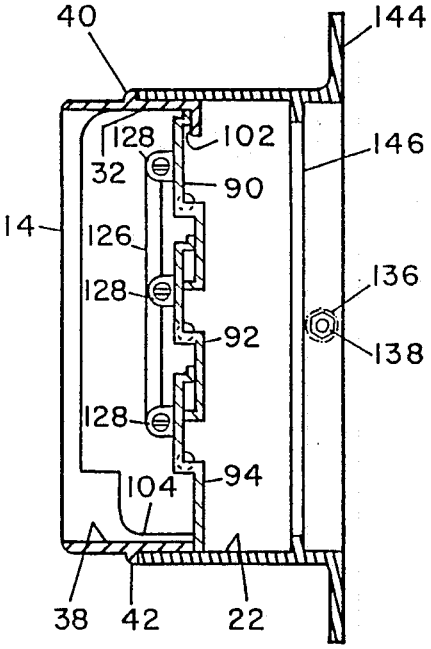
FIG. 2 illustrates a cross-sectional view taken along the lines 2—2 of FIG. 1.
Figure 3:
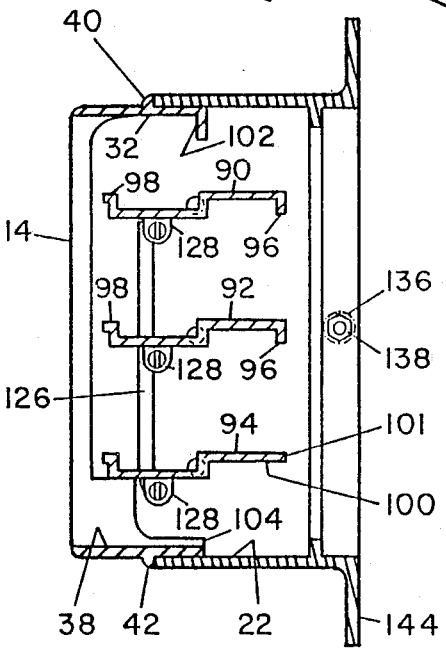
FIG. 3 illustrates a cross-sectional view taken along the lines 3—3 of FIG. 1.
Figure 4:
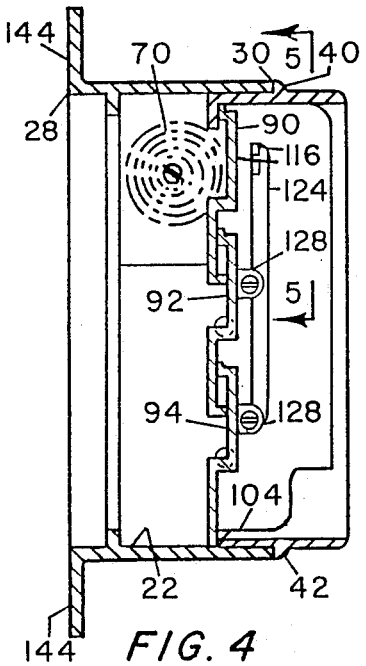
FIG. 4 illustrates a cross-sectional view taken along the lines 4—4 of FIG. 1 and having a coil spring shown in phantom with dashed lines.
Figure 6:
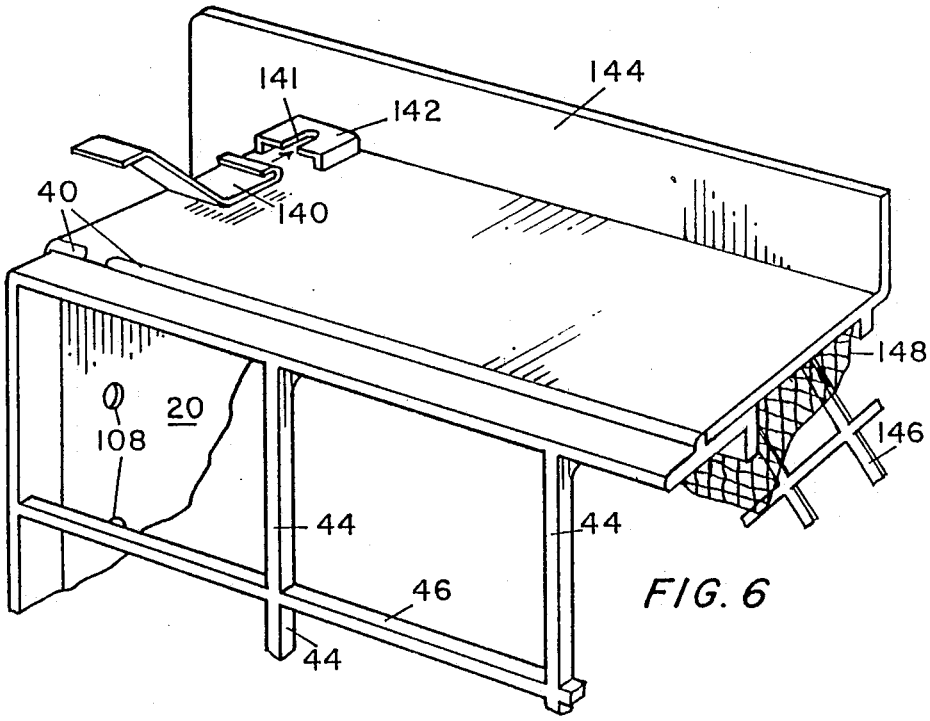
FIG. 6 illustrates a partial perspective rear view of an embodiment of a ventilator in accordance with the present invention.
Figure 7:
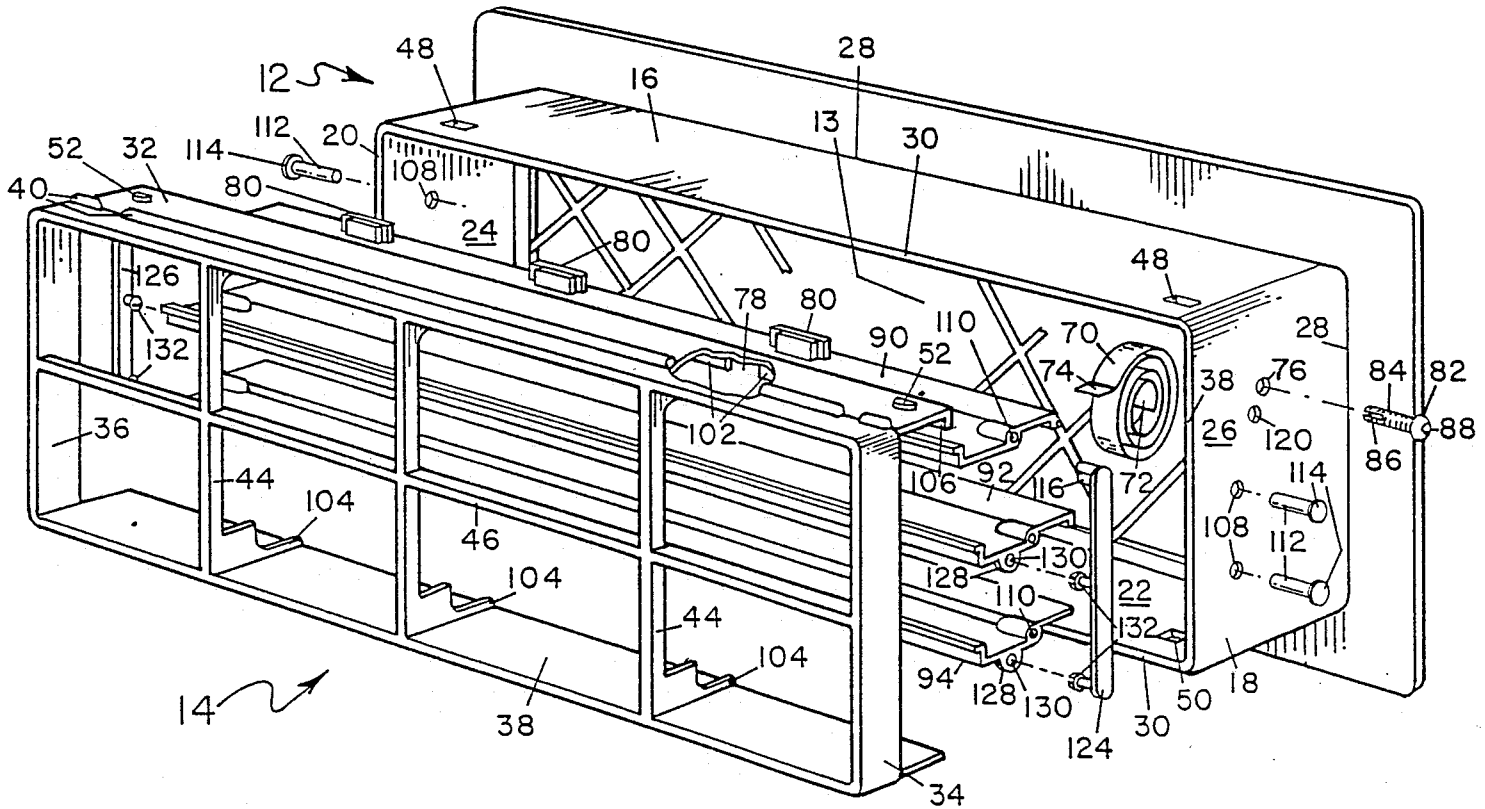
FIG. 7 illustrates a perspective plan view taken from the rear of an embodiment of the present invention with components shown prior to assembly.

In further accordance with the present invention, a removable backframe is provided and configured to engage the rear edge of the housing so as to be selectively engagable and disengagable by a manual motion that does not require the aid of tools or more than ordinary dexterity. As embodied herein and shown in FIG. 7 for example, a backframe 14 preferably defines a unitary structure that includes a top ledge 32, a first side strut 34, a second side strut 36 disposed opposite first side strut 34, and a bottom ledge 38 disposed opposite top ledge 32. As shown in FIGS. 2–4, 6 and 7 for example, an abutment ridge 40 extends from an intermediate portion of the exterior surface of top ledge 32. Similarly, as shown in FIGS. 2–4 for example, an abutment ridge 42 extends from the exterior surface of bottom ledge 38. As shown in FIGS. 6 and 7 for example, at least one rib 44 extends between top ledge 32 and bottom ledge 38, and preferably a plurality of ribs 44 are disposed in this fashion. Similarly, at least one cross brace 46 extends between first side strut 34 and second side strut 36. Ribs 44 and cross brace 46 provide support and rigidity to backframe 14. When backframe 14 is attached to housing 12, the rigidity of backframe 14 assists in maintaining the dimensional stability of housing 12 during installation and in use. This is one reason why backframe 14 is preferably fabricated of a more rigid polymeric material than housing 12.

In still further accordance with the present invention, means are provided for engaging the backframe to the housing. Preferably, the engaging means permits selective engagement and disengagement by the application of manual force and dexterity that does not require the use of any tools in the processes of engagement or disengagement. As embodied herein and shown in FIG. 7 for example, the means for engaging the backframe to the housing preferably includes a pair of top tab openings 48 defined in housing top 16, a pair of bottom tab openings 50 defined in housing bottom 22, a pair of attachment tabs 52 projecting outwardly from the outside surface of backframe top ledge 32, and a pair of attachment tabs (not shown) projecting outwardly from the outside surface of backframe bottom ledge 38. Preferably, top tab openings 48 and bottom tab openings 50 are disposed near their respective sidewall and closer to the rear edge of housing 12 than to the front edge of housing 12. Moreover, attachment tabs 52 are disposed on top ledge 32 so as to be in registry with top tabs opening 48 when backframe 14 engages housing 12. Similarly, the attachment tabs 54 on bottom ledge 38 are disposed so as to be in registry with bottom tab openings 50 when housing 12 engages backframe 14. The relative pliability and flexibility of the preferred polyvinyl plastic forming housing 12 and the relatively rigid and stiff preferred polymeric material forming backframe 14 facilitates the snap-in engagement and snap-out disengagement of backframe 14 with housing 12 and permits such operations to be conducted by the human hands unaided by any tools and without substantial effort and dexterity. Furthermore, when backframe 14 engages housing 12, abutment ridge 40 preferably butts against the rear edge of housing top 16, while abutment ridge 42 butts against the rear edge of housing bottom 22.

In accordance with the present invention, a box for housing a bimetallic spring (described hereafter) is disposed on an interior surface of one of the sidewalls of the housing. The box has a sidepanel disposed opposite the sidewall of the housing. The box also has a solid front panel that is disposed closer to the front edge of the housing than to the rear edge of the housing an shields the spring contained in the box from exposure to the environment. As embodied herein and shown in FIG. 5 for example, a spring box is generally designated by the numeral 56 and is defined by a sidepanel 58 disposed parallel and opposite first sidewall 18. Sidepanel 58 preferably defines a pivot bolt collar 60 that defines a pivot bolt hole 62 therethrough. Spring box 56 further preferably defines an upper wall 64 disposed between sidepanel 58 and first sidewall 18. A lower wall 66 (shown in phantom in FIG. 5) preferably is disposed between 10 sidepanel 58 and first sidewall 18 and is disposed opposite upper wall 64. As shown in FIG. 1 for example, a front panel 68 preferably is disposed closer to the front edge of the housing than to the rear edge of the housing and connects to sidepanel 58, first sidewall 18, upper wall 64 and lower wall 66. Front panel 68 preferably is disposed between the interior of spring box 56 and the outside environment to which ventilator 10 is exposed. Unlike the bimetallic spring elements disposed in the air passageway in prior vents, front panel 68 closes off all air and light gaps around the spring and shields it from the environment. Preferably, spring box 56 constitutes a unitary structure along with housing 12 and is molded from polymeric material in the same mold used to form housing 12. The rear of spring box 56 remains open and exposed to the temperature of the environment in order to enable the spring contained therein to respond appropriately, as will be explained hereafter.

In still further accordance with the present invention, a bimetallic element is disposed in the spring box to provide the temperature sensitive means for opening and closing the ventilator to the passage of air therethrough. As embodied herein and shown in FIGS. 5 and 7 for example, the temperature sensitive element preferably defines a bimetallic coil 70 having an inner free end 72 disposed at the innermost portion of the coil and an outer free end 74 disposed at the outermost circumference of the coil. Bimetallic coil 70 expands and contracts according to the temperature of its environment. In so doing, coil 70 provides the necessary force to open and close ventilator 10 to the passage of air therethrough, as is explained more fully below.

The present invention further includes a setting plug that is disposed through a setting plug hole to hold the inner end of the bimetallic coil against rotation. As 10 embodied herein and shown in FIG. 7 for example, a setting plug hole 76 preferably is defined through first sidewall 18. Preferably, setting plug hole 76 defines a first cylindrical surface joined by a ridge surface to a second cylindrical surface, which has a larger diameter than the first cylindrical surface and is disposed closer to the exterior surface of first sidewall 18 than to the interior surface of first sidewall 18. The ridge surface preferably is disposed radially at a right angle relative to the two cylindrical surfaces. As embodied herein and shown in FIGS. 5 and 7 for example, a setting plug 84 preferably is formed of molded plastic and is configured to extend through setting plug hole 76. One free end of setting plug 84 is bifurcated and defines a slot 86 therein that grasps inner end 72 of coil 70 and holds it against rotation as the coil expands and contracts. Since the inner end of the coil is held fixed by the setting plug, the expansion of the coil moves the outer end of the coil and provides a driving force that is harnessed, as will be explained hereafter. The opposite end of the setting plug defines a head flange 82. When in place in setting plug hole 76, the head flange of setting plug 84 is almost flush with the outer surface of first sidewall 18. A recess 88 extends longitudinally into setting plug 84 from the head flange and is configured to nonrotatably receive a tool therein by which the setting plug can be selectively rotated in the setting plug hole. Details of a suitable setting plug are described in U.S. Pat. No. 4,715,532, which is hereby incorporated herein by reference.

In further accordance with the present invention, at least two louvers are provided and rotatably disposed across the air passageway. Rotation of each louver about a longitudinal axis thereof functions to open the air passageway to admit air and light through the ventilator in one position of the louvers and functions to close the air passageway to prevent air and light from passing through the ventilator in a second position of the louvers. As embodied herein and shown in FIGS. 2, 3 and 7 for example, preferably each of three louvers 90, 92, and 94 defines an elongated body with a longitudinal axis along the length thereof. A top louver 90 is disposed adjacent spring box 56 and is shorter in length than the other two louvers 92, 94. As shown in FIG. 3 for example, a middle louver 92 is disposed between the other two louvers and preferably has a transverse-section that defines a generally S-shaped configuration and includes a rearward-extending free edge 96 and a forward-extending free edge 98. Top louver 90 is similarly shaped. However, bottom louver 94 has a flat trailing edge 100 in place of the rearward-extending free edge found in top louver 90 and middle louver 92. As shown in FIG. 4 for example, in the closed position, the forward-extending edge of middle louver 92 and the rearward-extending free edge of top louver 90 form a double-sided closure engagement, while the rearward-extending free edge of middle louver 92 and the forward-extending edge of bottom louver 94 forms a similar double-sided closure engagement. This arrangement provides positive closure surfaces for the louvers in the closed position. This positive closure blocks out both light and air from passing the louvers in the closed position.

Additional means are provided for positively engaging the louvers when the louvers are in a closed position. As embodied herein and shown in FIGS. 2 and 3 for example, the positive engagement means preferably includes a closure surface 102 extending at a right angle from top ledge 32 of backframe 14. Closure surface 102 extends toward bottom ledge 38 and extends lengthwise for substantially the entire length of top ledge 32. In the closed position, forward-extending edge 98 of top louver 90 positively engages closure surface 102 to block passage of air and light. As mentioned above, backframe 14 preferably is formed in a mold as a unitary structure. In doing so, spaces must be provided in closure surface 102 coincident with the positions where ribs 44 engage top ledge 32. As shown in a cut-away portion of FIG. 7 for example, these spaces 78 are filled by inserts 80 that are attached, as by gluing, after the backframe is released from the mold during the fabrication thereof. These inserts preferably are formed in the same mold with the backframe and are attached by thin members to one of the ribs when the backframe is fabricated. The thin members are easily snapped off to free the inserts, which then can be used to fill the spaces formed in closure surface 102. Any suitable means such as the application of adhesive can be used to hold inserts 80 in place in spaces 78 in closure surface 102.

As shown for example in FIGS. 2, 3, and 7, the means for positively engaging the louvers when the louvers are in a closed position further preferably includes at least one closure stop member 104. Each closure stop member 104 extends above the interior surface of bottom ledge 38 and extends to the forward free edge of bottom ledge 38. Preferably, a plurality of closure stop members are provided as shown in FIG. 7 for example. As shown in FIGS. 2–4 for example, each closure stop member 104 provides a stop surface that engages lowermost edge 100 of bottom louver 94. The thickness of the forward free edge of bottom ledge 38 is augmented by the presence of the closure stop members so as to make the amount of clearance between the lowermost edge (101 in FIG. 3) of the lowest louver 94 and the housing bottom less critical. This less critical clearance tolerance enables a plastic molding process to be used to fabricate the housing and the louvers, as well as the connecting rotational elements to be described hereafter. Accordingly, the closure stop members provide additional means for positively engaging the louvers when the louvers are in a closed position.

In further accordance with the present invention, means are provided for substantially preventing the passage of air and light through the air passageway when the ventilator is in a closed position. As embodied herein and shown in FIGS. 1 and 7 for example, such means preferably includes a closure flap 106 extending from top ledge 32 at a right angle from top ledge 32. Closure flap 106 extends toward bottom ledge 38 and preferably extends for a greater distance than closure surface 102. As shown in FIG. 1 for example, closure flap 106 preferably is disposed so as to be in at least partial registry with spring box 56 when backframe 14 engages the rear edge of housing 12. Closure flap 106 blocks the clearance spacing between sidepanel 58 and the end of top louver 90 so as to prevent passage of air and light past closure flap 106.

Preferably, backframe 14, closure surface 102, closure stop member 104, and closure flap 106 define a unitary structure formed by molding a polymeric material in a single mold operation.

Figure 5:
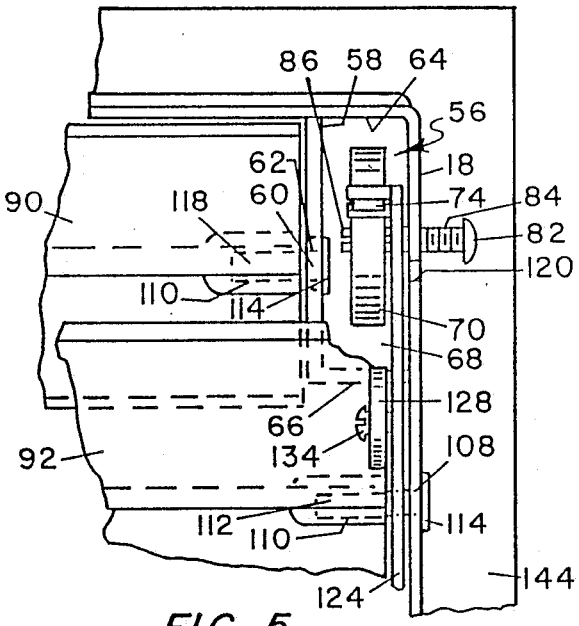
FIG. 5 illustrates an expanded detail plan view taken along the lines 5—5 of FIG. 4 and having certain features shown in phantom with dashed lines.

In yet further accordance with the present invention, means are provided for supporting each louver for rotation about the longitudinal axis of rotation of the louver. As embodied herein and shown in FIGS. 5–7 for example, the means for rotationally supporting each louver preferably includes louver post holes 108 defined through first sidewall 18 and additional louver post holes 108 defined through second sidewall 20. The three louver post holes defined in second sidewall 20 are disposed along a generally centrally located vertical line to correspond to each of the three louvers disposed internally of the air passageway defined by housing 12. The two louver post holes defined in first sidewall 18 are disposed in registry with the lower two holes in second sidewall 20. As shown in FIGS. 5 and 7 for example the rotational supporting means for the louvers further preferably includes a pivot bolt recess 110 defined longitudinally in each opposite end of each louver 90, 92, and 94. Recess 110 is shown in phantom (dotted lines) in FIG. 5. Preferably, each pivot bolt recess is defined in registry with the longitudinal centerline axis of each louver, which also corresponds to the rotational axis of each louver. As shown for example in FIGS. 5 and 7, the rotational supporting means for each louver further preferably includes at least one pivot bolt 112. Preferably, each pivot bolt 112 has a shaft which is configured to press fit into each louver post hole 108 in first and second sidewalls 18, 20 and project into the air passageway defined by housing 12. The ends of each pivot bolt 112 projecting into the air passageway are rotatably received within pivot bolt recesses 110 configured in the ends of middle and bottom louvers 92, 94 and in the end of top louver 90 disposed adjacent second sidewall 20.

As embodied herein and shown in FIG. 7 for example, the means for rotationally supporting the louvers preferably further includes a pivot bolt collar 60 defined near the free edge of sidepanel 58 so as to be in registry with a corresponding louver post hole 108 defined through second sidewall 20. Pivot bolt collar 60 defines a pivot bolt hole 62 therethrough positioned so as to be in registry with the louver post hole uppermost in second sidewall 20 to rotatably support top louver 90. As shown in FIG. 7 for example, the rotational supporting means for the louver further preferably includes a pivot bolt 118 which has a shaft with a free end extending through pivot bolt hole 62 and into a corresponding pivot bolt recess 110 disposed in the end of top louver 90 adjacent sidepanel 58. Pivot bolt 118 can have a shorter shaft than pivot bolts 112, because the thickness of sidepanel 58 is preferably less than the thickness of sidewalls 18, 20. As shown in FIGS. 5 and 7 for example, each pivot bolt 112, 118 preferably has a head 114 integrally attached to the opposite end of the pivot bolt shaft and extending radially at a right angle to the shaft.

As noted above, spring box 56 preferably constitutes a unitary structure with housing 12 and is molded at the same time as housing 12 and in the same mold. Accordingly, a special provision must be made for the insertion of a tool into the mold to form pivot bolt hole 62. As shown in FIG. 7 for example, this is accomplished in the present invention by providing a tool access opening 120 defined through first sidewall 18 and oriented in concentric registry with pivot bolt hole 62 to be defined in sidepanel 58 of spring box 56. Furthermore, an insert (not shown) is configured to fill tool access opening 120 and is disposed therein to seal same in the finished ventilator. The insert preferably is formed of molded plastic as a cap which snaps into access opening 120 or is held therein by an adhesive.

Alternative embodiments can provide the means for rotationally supporting each louver. For example, pivot bolts 118, 112 can be rotationally received in louver post holes 108 and press fitted into, and thus nonrotatably held in, pivot bolt recesses 110. Moreover, the shaft portion of each pivot bolt can be molded as a unitary structure forming part of each sidewall 18, 20 and sidepanel 58. In this latter embodiment, the tool access opening and the insert to seal same are not needed. However, the bending of such shafts in order to insert them into the pivot bolt recesses 110 defined in the ends of the louvers may cause sufficient misalignment to interfere with the reliable rotation of the louvers.

In still further accordance with the present invention, means are provided for linking the louvers for simultaneous rotation about each longitudinal axis of rotation of the louver. As embodied herein and shown in FIGS. 2–5 and 7 for example, the louver linking means preferably includes a drive element 124 (FIGS. 4, 5 and 7), a linkage element 126 (FIGS. 2–4 and 7), and a plurality of receiving collars 128, each receiving collar defining a rotation post hole 130 therethrough. Drive element 124 preferably defines an elongated member that has on one side thereof at least two rotation posts 132 extending at right angles therefrom and spaced apart to correspond to the spacing between bottom louver 94 and middle louver 92. One end of drive element 124 has a forked member 116 defined therein and configured for receiving outer free end 74 of coil 70 therein. As shown in FIG. 5 for example, each rotation post 132 defines a bifurcated shaft defining a flared head 134 at the free end of the shaft. As shown in FIGS. 2–5 and 7 for example, each end of bottom louver 94 and middle louver 92 and one end of top louver 90 have defined thereon a receiving collar 128 which defines a rotation post hole 130. Receiving collars 128 are disposed at a location other than the rotational axis of the louver. Accordingly, each respective rotation post hole 130 is disposed out of registry with each pivot bolt recess 110 defined in the end of the louver. The separation between rotation post hole 130 and pivot bolt recess 110 determines the amount of leverage applied during opening and closing of the louvers. Rotation posts 132 of drive element 124 are inserted through receiving collars 128 in the ends of bottom and middle louvers 94, 92 disposed near spring box 56. As shown in FIGS. 2, 3 and 7 for example, linkage element 126 defines an elongated member having at least three rotation posts 132 defined thereon and spaced apart according to the relative spacing of the three louvers. Each rotation post of linkage 126 is disposed through a corresponding receiving collar 128 on the end of each louver opposite the end disposed adjacent spring box 56.

In operation, the expansion or contraction of coil 70 is transmitted to the louvers by movement of outer end 74 of coil 70. This movement results because inner end 72 is held fixed by setting plug 84. Movements of outer end 74 of coil 70 move drive element 124. Translational movement of drive element 124 by coil 70 results in movement of bottom and middle louvers, 92, 94, which are pivotally mounted to drive element 124 via respective rotation posts 132 and receiving collars 128. This movement of bottom louver 94 and middle louver 92 is translated to top louver 90 via linkage element 126. Each rotation post of linkage element 126 is rotatably received within the respective receiving collar 128 of each louver, including a receiving collar 128 on the end of top louver 90 opposite the end that is adjacent spring box 56.

The bifurcated flared heads 134 of the rotation posts disposed on drive element 124 and linkage element 126 permit the rotation posts to be deformed in order to fit into receiving collars 128. The resilience of the plastic material which preferably forms linkage element 126 and drive element 124 and their respective rotation posts 132 readily springs back, and flared head 134 prevents disengagement of the rotation posts from the receiving collars. The engagement and disengagement of the louvers to the respective rotation posts of the drive element and the linkage element are easily effected by hand without the aid of tools and without more than ordinary hand-eye coordination. This feature permits the louvers to be disassembled readily from the ventilator so that they may be easily cleaned. Thus, the louvers can be placed in a bath to remove any mildew or dirt buildup, if desired. The plastic material also facilitates cleaning and prevents any rust buildup or pitting, as might occur with a metallic louver. Access to the louvers is readily provided by removing backframe 14 from housing 12 by disengaging the attachment tabs 52, 54 from their respective tab openings 48, 50. This too can be accomplished by hand without the aid of tools and without more than ordinary manual dexterity.

In some embodiments of the present invention, means are provided for securing the ventilator in the installation opening in a foundation or other structure. As embodied herein and shown in FIGS. 1–3 for example, such means preferably includes an attachment opening 136 defined through second sidewall 20. Attachment opening 136 is configured to nonrotatably receive a nut 138, which has a threaded opening therethrough and is used to receive a threaded installation bolt 139 which can be threaded through nut 138 from the interior of the passageway and into the surface of the installation opening that is provided to receive the ventilator in the foundation structure. In an alternative means of securing the ventilator in the installation opening, a pair of installation clips can be provided at the top and/or bottom of the housing. As embodied herein and shown in FIG. 6 for example, a clip holder 142 is disposed on the exterior surface of top 16 near the front edge of the housing. Though not shown in the FIGS., another clip holder 142 can be disposed on the opposite end of top 16. Each clip holder 142 is configured to receive one end of an installation clip 140. A slot 141 is defined through each clip holder 142 and extends along most of the length thereof and near the center thereof to provide some provision to adapt the size of the clip holder 142 to the end of the installation clip to be inserted therein.

Preferably, as shown in the FIGS., housing 12 defines a front edge collar 144 around the periphery thereof and near the front edge thereof. Front edge collar 144 preferably defines an uninterrupted and continuous flange extending at a right angle from the exterior of housing 12 at a location closer to the front edge of housing 12 than to the rear edge of housing 12. As shown in FIG. 6 for example, clip holders 142 preferably are disposed between the underside of collar 144 and the rear edge of housing 12. Front collar 144 preferably constitutes a unitary structure with the rest of housing 12 and is molded at the same time and in the same mold as the rest of housing 12.

In some embodiments of the present invention, as shown in FIGS. 1 and 6 for example, a grille 146 is integrally connected to housing 12 and front panel 68 of spring box 56. Preferably, grille 146 is disposed across the air passageway defined by housing 12 and defines open spaces through a grid work of members which constitute grille 146. A screen 148 formed of nylon or metal can be disposed against the back side of grille 146 and connected thereto to provide a finer filtering of air passing through grille 146, which is intended to face the exterior environment of the foundation containing the ventilator. Screen 148 can be attached by heat sealing or applying a suitable adhesive. Preferably, grille 146 constitutes part of a unitary polymeric structure with the rest of housing 12, spring box 56, and front edge collar 144. All of these various structures preferably are molded together of the same polymeric material in the same mold in a single molding operation.

What is claimed is:

1. A temperature actuating ventilator, comprising:

(a) a housing defining an air passageway therethrough, said housing integrally defining a top, a first sidewall, a bottom, and a second sidewall, said housing and each of said top, bottom, and sidewalls further defining a front edge and a rear edge opposite said front edge;

(b) a spring box disposed on an interior surface of said first sidewall, said box having a sidepanel disposed opposite said first sidewall, said box having a front panel disposed closer to said front edge of said housing than to said rear edge of said housing;

(c) a front collar integrally connected at a right angle from said housing;

(d) at least two elongated louvers, each said louver defining a longitudinal axis of rotation, one of said louvers being shorter than at least one other and having one end disposed near said spring box sidepanel;

(e) means for supporting each said louver for rotation about said longitudinal axis of rotation;

(f) an elongated drive element pivotally connected to at least one of said louvers;

(g) means linking said louvers for simultaneous rotation about each longitudinal axis of rotation of each said louver;

(h) a bimetallic coil disposed in said spring box and having a free end disposed outside said coil and engaging said drive element, said coil having an opposite free end disposed inside said coil;

(i) a removable backframe configured to engage said rear edge of said housing, said backframe having a top ledge and a bottom ledge integrally connected to and disposed opposite each other, each of said top ledge and said bottom ledge having an interior surface facing toward the other and an exterior surface facing away from the other, said bottom ledge having a forward free edge and a rearward free edge, said backframe having means for engaging said housing, said bottom ledge having a louver rotation stop extending above said interior surface of said bottom ledge and disposed closer to said rearward free edge of said bottom ledge than to said forward free edge of said bottom ledge; and (j) means for positively engaging said louvers when said louvers are in a closed position.

2. An apparatus as in claim 1, wherein:

said means for positively engaging said louvers when said louvers are in a closed position includes a closure surface extending at a right angle from said top ledge and toward said bottom ledge; and at least one closure stop extending above said interior surface of said bottom ledge and extending to said forward free edge of said bottom ledge, said closure stop member for engaging at least one louver.

3. An apparatus as in claim 1, wherein:

said means for positively engaging said louvers when said louvers are in a closed position includes a closure flap extending from said top ledge at a right angle thereto and toward said bottom ledge, said closure flap being disposed so as to be in at least partial registry with said spring box when said backframe engages said rear edge of said housing.

4. An apparatus as in claim 1, wherein:

said housing and said spring box define a unitary member formed of molded polymeric material.

5. An apparatus as in claim 1, wherein:

said backframe defines a unitary member formed of molded polymeric material.

6. An a as in claim 1, further comprising:
a grille integrally connected to said housing and said front panel of said spring box and disposed across said air passageway; and
wherein said housing, said grille, and said spring box define a unitary member formed of molded polymeric material.

7. An apparatus as in claim 1, wherein:
said means for linking said louvers for simultaneous rotation about each longitudinal axis of rotation of each said louver includes an elongated linkage element rotatably connected to each said louver at a location other than along the longitudinal axis of each said louver.

8. An apparatus as in claim 1, further comprising:
at least one louver post hole defined through said first sidewall;
at least two louver post holes defined through said second sidewall, one of said two louver post holes being disposed closer to said top than to said bottom, the other of said two louver post holes being disposed closer to said bottom than to said top, one of said two louver post holes being disposed in registry with said at least one louver post hole in said first sidewall;
a pivot bolt recess defined longitudinally in each opposite end of each said louver;
one end of each said louver defining a first receiving collar and the opposite end of each said louver defining a second receiving collar, each said receiving collar further defining a rotation post hole therethrough, 17 at least one of said louvers defining a generally S-shaped transverse cross-section, said S-shaped louver having a rearward-extending free edge;
at least one pivot bolt, each said pivot bolt having a shaft and a head disposed transversely to said shaft, each said pivot bolt shaft extending into one of said pivot bolt recesses of one of said louvers to rotatably support one end of said corresponding louver;
wherein said elongated drive element having at least one rotation post extending therefrom and through one of said receiving collars of one of said louvers to rotatably engage said collar, each said rotation post having a bifurcated shaft and defining a flared head at the free end thereof; and
wherein said means for linking said louvers for simultaneous rotation about each longitudinal axis of rotation of each said louver includes an elongated linkage element having at least two spaced apart rotation posts extending therefrom, each said rotation post extending rotatably through a respective receiving collar on opposite ends of said louvers from the ends receiving said rotation post of said drive element.

9. An apparatus as in claim 1, wherein:
said means for supporting each said louver for rotation about said longitudinal axis of rotation includes a pivot bolt collar defining a pivot bolt hole through said sidepanel of said box; and
a pivot bolt extending through said pivot bolt hole in said first sidepanel of said box and rotatably engaging said shorter louver disposed near said box.

10. An apparatus as in claim 9, further comprising:
a tool access opening defined through said first sidewall, said tool access opening being oriented in concentric registry with said pivot bolt hole defined in said sidepanel of said box.

11. An apparatus as in claim 10, further comprising:
an insert configured to fill said tool access opening and disposed therein to seal same.

12. An apparatus as in claim 1, wherein:
each said louver having a forward-extending free edge, and at least one of said louvers defining a rearward-extending free edge.

13. An apparatus as in claim 1, wherein:
said means for engaging said backframe to said housing includes a pair of top tab openings defined in said housing top and disposed closer to said rear edge than to said front edge, a pair of bottom tab openings defined in said housing bottom and disposed closer to said rear edge than to said front edge, at least two attachment tabs projecting outwardly from each outside surface of each of said top and bottom backframe ledges and disposed in registry with said tab openings in said respective top and bottom of said housing when said backframe engages said rear edge of said housing.

14. An apparatus as in claim 1, further comprising:
an attachment opening defined in said second sidewall and configured to non-rotatably receive a nut; and
a nut nonrotatably disposed in said attachment opening, said nut having a threaded opening therethrough.

15. An apparatus as in claim 1, further comprising:
a pair of clip housings disposed on the exterior surface of said top and spaced apart from each other near said front edge, each said clip housing having an upper wall with a slot defined therethrough and extending along most of the length thereof and near the center thereof.

16. A temperature actuating ventilator, comprising:
(a) a housing defining an air passageway therethrough, said housing integrally defining a top, a first sidewall, a bottom, and a second sidewall, said housing and each of said top, bottom, and sidewalls further defining a front edge and a rear edge opposite said front edge;
(b) a spring box disposed on an interior surface of said first sidewall, said box having a sidepanel disposed opposite said first sidewall, said box having a front panel disposed closer to said front edge of said housing than to said rear edge of said housing and extending from said interior surface of said first sidewall to connect to said sidepanel and shield said spring box from air flow emanating from said front edge of said housing;
(c) a front collar integrally connected at a right angle from said housing;
(d) at least two elongated louvers, each said louver defining a longitudinal axis of rotation, one of said louvers being shorter than at least one other said louver and having one end disposed near said spring box sidepanel;
(e) means for supporting each said louver for rotation about said longitudinal axis of rotation;
(f) an elongated drive element pivotally connected to at least one of said louvers;
(g) means for selectively linking said louvers for simultaneous rotation and selectively disengaging said louvers for manual removal from said ventilator without the aid of tools;
(h) a bimetallic coil disposed in said spring box and engaging said drive element; and (i) a removable backframe configured to engage said rear edge of said housing.

17. A temperature actuating ventilator, comprising:

(a) a housing defining an air passageway therethrough, said housing integrally defining a top, a first sidewall, a bottom, and a second sidewall, said housing and each of said top, bottom, and sidewalls further defining a front edge and a rear edge opposite said front edge;

(b) a spring box disposed on an interior surface of said first sidewall, said box having a sidepanel disposed opposite said first sidewall, said box having a front panel disposed closer to said front edge of said housing than to said rear edge of said housing;

(c) a front collar integrally connected at a right angle from said housing;

(d) at least two elongated louvers, each said louver defining a longitudinal axis of rotation, one of said louvers being shorter than at least one other said louver and having one end disposed near said spring box sidepanel;

(e) means for supporting each said louver for rotation about said longitudinal axis of rotation;

(f) an elongated drive element pivotally connected to at least one of said louvers;

(g) means for selectively linking said louvers for simultaneous rotation and selectively disengaging said louvers for manual removal from said ventilator without the aid of tools;

(h) a bimetallic coil disposed in said spring box and engaging said drive element;

(i) a removable backframe configured to engage said rear edge of said housing;

an elongated linkage element having at least two spaced apart rotation posts extending therefrom;

wherein said manually disengagable louver rotatable linkage means includes a first receiving collar defined in one end of each said louver and a second receiving collar defined in the opposite end of each said louver, each said receiving collar further defining a rotation post hole therethrough;

wherein said elongated drive element having at least one rotation post extending therefrom and through one of said receiving collars of one of said louvers to rotatably engage said collar, each said rotation post having a bifurcated shaft and defining a flared head at the free end thereof; and wherein each said linkage element rotation post extending rotatably through a respective receiving collar on opposite ends of said louvers from the ends receiving said rotation post of said drive element.

18. A temperature actuating ventilator, comprising:

(a) a housing defining an air passageway therethrough, said housing integrally defining a top, a first sidewall, a bottom, and a second sidewall, said housing and each of said top, bottom, and sidewalls further defining a front edge and a rear edge opposite said front edge;

(b) a spring box disposed on an interior surface of said first sidewall, said box having a sidepanel disposed opposite said first sidewall, said box having a front panel disposed closer to said front edge of said housing than to said rear edge of said housing;

(c) a front collar integrally connected at a right angle from said housing;

(d) at least two elongated louvers, each said louver defining a longitudinal axis of rotation, one of said louvers being shorter than at least one other said louver and having one end disposed near said spring box sidepanel;

(e) means for supporting each said louver for rotation about said longitudinal axis of rotation;

(f) an elongated drive element pivotally connected to at least one of said louvers;

(g) means for selectively linking said louvers for simultaneous rotation and selectively disengaging said louvers for manual removal from said ventilator without the aid of tools;

(h) a bimetallic coil disposed in said spring box and engaging said drive element; and (i) a removable backframe configured to engage said rear edge of said housing, said backframe having a top ledge and a bottom ledge integrally connected to and disposed opposite each other, each of said top ledge and said bottom ledge having an interior surface facing toward the other and an exterior surface facing away from the other, said bottom ledge having a forward free edge and a rearward free edge, each of said top and bottom ledges having an abutment ridge extending from respective exterior surfaces of said ledges and for disposing against said rear edge of said housing, said backframe having means for engaging said housing, said top ledge having a closure surface extending at a right angle therefrom and toward said bottom ledge, said top ledge having a closure flap integral with said closure surface and extending from said top ledge at a right angle thereto and toward said bottom ledge, said closure flap being disposed so as to be in at least partial registry with said spring box when said backframe engages said rear edge of said housing, said bottom ledge having at least one closure stop member extending above said interior surface of said bottom ledge and extending to said forward free edge of said bottom ledge, said closure stop member for engaging said rearward-extending free edge of said at least one louver, said bottom ledge having a rotation stop member extending above said interior surface of said bottom ledge and disposed closer to said rearward free edge of said bottom ledge than to said forward free edge of said bottom ledge.

19. An apparatus as in claim 18, wherein:

said means for engaging said backframe to said housing includes a pair of top tab openings defined in said housing top and disposed closer to said rear edge than to said front edge, a pair of bottom tab openings defined in said housing bottom and disposed closer to said rear edge than to said front edge, at least two attachment tabs projecting outwardly from each outside surface of each of said top and bottom backframe ledges and disposed in registry with said tab openings in said respective top and bottom of said housing when said backframe engages said rear edge of said housing.

20. A temperature actuating ventilator, comprising:

(a) a housing defining an air passageway therethrough, said housing integrally defining a top, a first sidewall, a bottom, and a second sidewall, said bottom being disposed opposite said top, said first sidewall being connected between a first end of said top and a first end of said bottom, said second sidewall being connected between a second end of said top and a second end of said bottom, said housing and each of said top, bottom, and sidewalls further defining a front edge and a rear edge opposite said front edge;

(b) said top defining a pair of top tab openings disposed closer to said rear edge than to said front edge, one of said top tab openings disposed closer to said first sidewall than to said second sidewall, and said other of said top tab openings disposed closer to said second sidewall than to said first sidewall;

(c) said bottom defining a pair of bottom tab openings disposed closer to said rear edge than to said front edge, one of said bottom tab openings disposed closer to said first sidewall than to said second sidewall, and said other of said bottom tab openings disposed closer t said second sidewall than to said first sidewall;

(d) each of said sidewalls having an interior surface facing towards said opposite sidewall and an exterior surface facing away from said opposite sidewall;

(e) said first sidewall defining at least one louver post hole therethrough;

(f) said second sidewall defining at least two louver post holes, one of said two louver post holes being disposed closer to said top than to said bottom, the other of said two louver post holes being disposed closer to said bottom than to said top, one of said two louver post holes being disposed in registry with said at least one louver post hole in said first sidewall;

(g) said second sidewall having an attachment opening configured to non-rotatably receive a nut;

(h) a nut nonrotatably disposed in said attachment opening, said nut having a threaded opening therethrough;

(i) a pair of clip holders disposed on the exterior surface of said top and spaced apart from each other near said front edge, each said clip holder having an upper wall with a slot defined therethrough and extending along most of the length thereof and near the center thereof;

(j) a spring box disposed on said interior surface of said first sidewall, said box having a sidepanel disposed opposite said first sidewall, said sidepanel having a pivot bolt collar defining a pivot bolt hole therethrough, said box having a front panel disposed closer to said front edge of said housing than to said rear edge of said housing;

(k) said first sidewall having a setting plug hole defined therethrough, said setting plug hole being defined by two cylindrical surfaces joined by a ridge surface, one of said cylindrical surfaces having a larger diameter and being disposed closer to said exterior surface of said first housing sidewall than to said interior surface of said first housing sidewall, said ridge surface being disposed at a right angle to said cylindrical surfaces;

(l) said first sidewall defining a tool access opening therethrough, said tool access opening being oriented in concentric registry with said pivot bolt hole defined in said sidepanel of said box;

(m) a front edge collar disposed closer to said front edge of said housing than to said rear edge of said housing, said flange extending at a right angle from said housing;

(n) a removable backframe configured to engage said rear edge of said housing, said backframe having an integrally connected top ledge, a first side strut, a bottom ledge disposed opposite said top ledge, and a second side strut disposed opposite said first side strut, each of said top and bottom ledges having an abutment ridge extending from respective exterior surfaces of said ledges and for disposing against said rear edge of said housing, each of said top and bottom ledges having at least two attachment tabs projecting outwardly from an outside surface of said ledge and disposed in registry with said tab openings in said respective top and bottom of said housing when said backframe engages said rear edge of said housing, said top ledge having a closure surface extending at a right angle therefrom and toward said bottom ledge, said top ledge having a closure flap integral with said closure surface and extending from said top ledge at a right angle thereto and toward said bottom ledge, said closure flap being disposed near one of said struts so as to be in at least partial registry with said spring box when said backframe engages said rear edge of said housing, said backframe having at least one rib extending between said top ledge and said bottom ledge, said backframe having at least one cross brace extending between said first strut and said second strut, said bottom ledge having at least one closure stop member extending above the interior surface of said bottom ledge and extending to a forward free edge of said bottom ledge, said bottom ledge having a rotation stop member extending above the interior surface of said bottom ledge and disposed closer to a rearward free edge of said bottom ledge than to said forward free edge of said bottom ledge;

(o) at least two elongated louvers, each said louver defining a longitudinal axis of rotation, each opposite end of each said louver defining a pivot bolt recess disposed longitudinally therein, one end of each said louver defining a first receiving collar and the opposite end of each said louver defining a second receiving collar, each said receiving collar defining a rotation post hole therethrough, each said louver having a forward-extending free edge, at least one of said louvers defining a generally S-shaped transverse cross-section, said S-shaped louver having a rearward-extending free edge, one of said louvers being shorter than said other louver and having one end disposed near said spring box sidepanel;

(p) at least one pivot bolt, each said pivot bolt having a shaft and a head disposed transversely to said 12 shaft, each said pivot bolt shaft extending into one of said pivot bolt recesses of one of said louvers to rotatably support one end of said corresponding louver;

(q) an elongated drive element having at least one rotation post extending therefrom and through one of said receiving collars of one of said louvers to rotatably engage said collar, each said rotation post having a bifurcated shaft and defining a flared head at the free end thereof;

(r) an elongated linkage element having at least two spaced apart rotation posts extending therefrom, each rotation post extending rotatably through a respective receiving collar on opposite ends of said louvers from the ends receiving said rotation post of said drive element;

(s) a bimetallic coil disposed in said spring box and having a free end disposed from the outer circumference of said coil and engaging said drive element, said coil having an opposite free end disposed inside said coil;

(t) a setting plug having a shaft configured to extend through said setting plug hole defined in said first sidewall, one end of said shaft being bifurcated and the opposite end of said shaft having a head flange extending radially from said shaft, said inner end of said coil being held by said bifurcated end of said setting plug, said head flange and a portion of said setting plug shaft defining a longitudinally extending recess configured for receiving a tool therein by which said setting plug can be selectively rotated in said setting plug hole;

(u) a pivot bolt extending through said pivot bolt hole defined in said pivot bolt collar in said first sidepanel of said spring box, said pivot bolt rotatably engaging said pivot bolt recess in the end of said shorter louver disposed near said box;

(v) a grille integrally connected to said housing and said front panel of said spring box and disposed across said air passageway;

(w) a screen disposed against said grille; and (x) an insert configured to fill said tool access opening and disposed therein to seal same.

* * * * *